US009903144B2

(12) United States Patent
Gibson

(10) Patent No.: US 9,903,144 B2
(45) Date of Patent: Feb. 27, 2018

(54) DOOR JAM STOPPER DEVICE

(71) Applicant: Jerrold A. Gibson, Chapel Hill, NC (US)

(72) Inventor: Jerrold A. Gibson, Chapel Hill, NC (US)

( * ) Notice: Subject to any disclaimer, the term of this patent is extended or adjusted under 35 U.S.C. 154(b) by 65 days.

(21) Appl. No.: 14/679,208

(22) Filed: Apr. 6, 2015

(65) Prior Publication Data

US 2016/0290024 A1 Oct. 6, 2016

(51) Int. Cl.
*E05C 17/00* (2006.01)
*E05C 17/12* (2006.01)
*E05C 17/50* (2006.01)

(52) U.S. Cl.
CPC ..... *E05C 17/025* (2013.01); *E05C 17/12* (2013.01); *E05C 17/50* (2013.01)

(58) Field of Classification Search
CPC ..... E05C 17/025; E05C 17/00; E05C 17/04; E05C 17/045; E05C 17/12; E05C 17/50
USPC ..... 403/87, 91, 97
See application file for complete search history.

(56) References Cited

U.S. PATENT DOCUMENTS 29,590 A * 8/1860 Hall ..... F16C 11/10 172/739
295,922 A * 4/1884 Hood ..... A01B 1/20 172/375
308,335 A * 11/1884 Haegg ..... A01B 3/18 16/93 R
338,264 A * 3/1886 Gilliam ..... F16C 11/10 16/110.1
361,519 A * 4/1887 Hewitt ..... A01B 1/06 15/105
663,121 A * 12/1900 Frost ..... A24F 19/0092 248/230.4
903,468 A * 11/1908 Griswold ..... F16C 11/10 403/97
1,068,170 A * 7/1913 Royce ..... B23Q 1/28 144/130
1,268,734 A * 6/1918 Lay ..... A46B 5/0083 403/290
1,616,265 A * 2/1927 Kroehling ..... E05C 17/025 109/60
2,555,226 A * 5/1951 Draughn ..... B25G 3/38 15/144.1
2,685,331 A * 8/1954 Gauntlett ..... B60R 22/105 182/4

(Continued)

*Primary Examiner* — Christopher M Koehler
(74) *Attorney, Agent, or Firm* — Adrienne Love

(57) ABSTRACT

A system and method of preventing the fixed side opening of a door from closing along the door jamb of a door frame. A guard device is provided generally comprising a pivoting member, an attachment member, a mounting system and a bumper. The pivoting member has a first end and a second end. An attachment member and bumper attach to the pivoting member. Mounting system connects to the attachment member at a central void. The mounting system connects to a prior art door stop of a door frame such that the guard device can swivel between a first position and a second position. In a first position guard device is proximate door stop such that the door is capable of fully closing against door stop. In a second position guard device is capable of maintaining the fixed side opening of the prior art door assembly. Bumper swivels outward to contact the end of the door. After guard device is engaged in the second position fixed side opening is incapable of narrowing.

10 Claims, 13 Drawing Sheets

(56) References Cited

U.S. PATENT DOCUMENTS 3,126,191 A * 3/1964 Holden ..... F16B 2/065 248/286.1
3,287,050 A * 11/1966 Ferrante ..... E05C 17/025 292/230
3,341,240 A * 9/1967 Hazard ..... E05C 17/025 200/6 BA
3,495,857 A * 2/1970 Hawke ..... E04B 1/5831 403/57
4,015,867 A * 4/1977 Siden ..... E05C 17/04 292/262
4,848,818 A * 7/1989 Smith ..... E04D 13/0765 15/236.04
5,133,553 A * 7/1992 Divnick ..... A63B 53/06 403/97
5,154,435 A * 10/1992 Chiu ..... B62B 1/045 280/47.315
5,236,213 A * 8/1993 Trickett ..... A61G 5/10 248/276.1
5,547,305 A * 8/1996 Treche ..... B25B 5/006 403/103
5,928,087 A * 7/1999 Emberton ..... A63B 53/06 403/97
6,409,411 B1 * 6/2002 Crorey ..... B25J 15/0052 403/54
6,619,872 B2 * 9/2003 Crorey ..... B25J 15/0052 403/54
6,789,809 B2 * 9/2004 Lin ..... B62B 1/12 280/47.18
7,047,655 B2 * 5/2006 Larsson ..... B43L 7/12 33/455
8,146,879 B2 * 4/2012 Liao ..... A45B 11/00 135/135
8,162,557 B2 * 4/2012 Van Zile, III ..... B25J 15/0052 403/385

* cited by examiner

DOOR JAM STOPPER DEVICE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for stopping a door from closing. More specifically, the invention comprises a doorjamb stop capable of engaging the door such that the doorjamb remains open and accessible.

2. Description of the Related Art

A door is a movable structure which blocks off or allows access to a room or other enclosed area. Doors are typically hung by hinges attached to a door frame, as shown in FIG. 1. The hinges 36 allow the door 52 to swing between a closed and open position (open position is illustrated in the prior art FIG. 1). Door frames generally consists of a casing, stop and a jamb. Hinges are connected to the jamb such that door can be flush against the casing when in a closed position. The stop is located along the center plane of the frame. In a closed position the door rests against the stop.

A door guard is a device that prevents the door from trapping fingers or other appendages as the door closes. Many door guard devices are directed to preventing the door from closing completely. However, the fixed-side opening along the jamb of the door closes prior to the swinging-side opening. Therefore, if the door guard is only directed to preventing the door from closing entirely, fingers or other appendages can still be caught between the door jamb and the door, proximate the hinges.

Additionally, prior art door guards often must be uninstalled or removed in order to close the door completely when not in use. If the prior art door guard is capable of remaining installed, it is integral with the door itself and complex.

Therefore what is needed is a door guard which can be easily installed and remain installed when not in use. Additionally, when in use, the door guard must prevent the fixed-side opening from closing. The present invention achieves this objective, as well as others that are explained in the following description.

BRIEF SUMMARY OF THE INVENTION

The present invention comprises a system and method of preventing the fixed side opening of a door from closing along the door jamb of a door frame. A guard device is provided generally comprising a pivoting member, an attachment member, a mounting system and a bumper. The pivoting member has a first end and a second end. The attachment member is preferably integral with the first end of the pivoting member. The bumper attaches to the second end of the pivoting member. Mounting system connects to the attachment member at a central void. The mounting system connects to a prior art door stop of a door frame such that the guard device can swivel between a first position and a second position. In a first position guard device is proximate door stop such that the door is capable of fully closing against door stop. In a second position guard device is capable of maintaining the fixed side opening of the prior art door assembly. Bumper swivels out to contact the end of the door (or hinged-side of the door). After guard device is engaged in the second position fixed side opening is incapable of narrowing.

REFERENCE NUMERALS IN THE DRAWINGS

| | | | |
|---|---|---|---|
| 10 | guard device | 12 | pivoting member |
| 14 | bumper | 16 | attachment member |
| 18 | bracket | 20 | mounting system |
| 22 | lip | 24 | disc |
| 26 | attachment member | 28 | bolt |
| 30 | knob | 32 | double-sided tape |
| 34 | door frame | 36 | hinge |
| 38 | handle | 40 | door jamb |
| 42 | hanging stile | 44 | latch stile |
| 46 | door stop | 48 | fixed side opening |
| 50 | swinging side opening | 52 | door |
| 54 | casing | 56 | bracket |
| 58 | lip | 60 | central void |

DETAILED DESCRIPTION OF THE INVENTION

Figure 1:
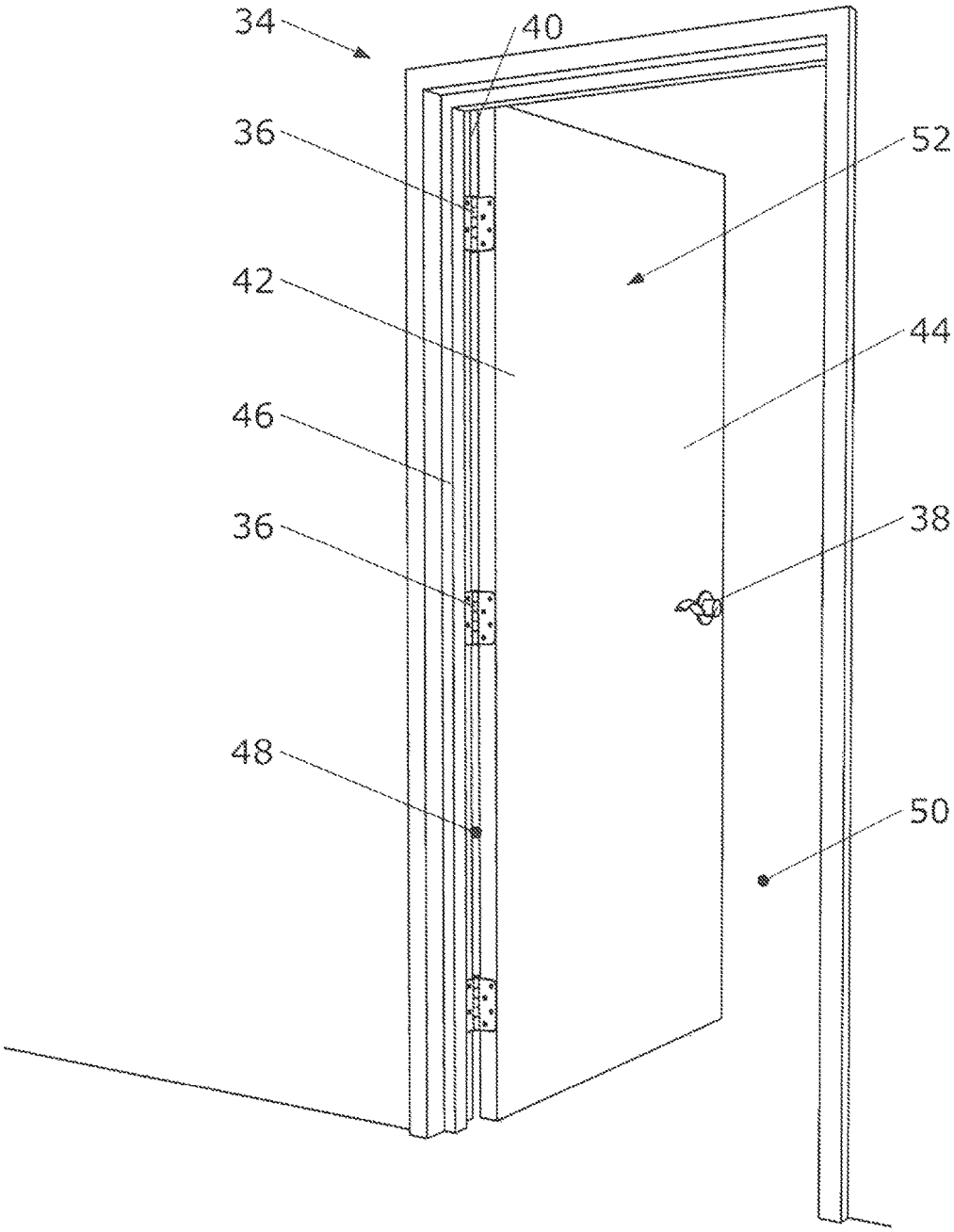
FIG. 1 (PRIOR ART)
FIG. 1 is a perspective view, showing a prior art door hung within a door frame.

A prior art door assembly is illustrated in FIG. 1. The present method of preventing the fixed side opening 48 of a prior art door 52 from closing along the door jamb 40 of a door frame 34 improves on prior art methods and systems. Prior art door frame 34 generally consists of a casing 54, stop 46 and jamb 40. Door 52 includes a latch stile 44 and a hanging stile 42. Latch stile 44 is a vertical portion of the door 52 that runs the full height of the door along the swinging side of the door 52. The handle 38, lock, disc or latch are mounted on the swinging side or latch stile 44. Hanging stile 42 is a vertical portion of the door that runs the full height of the door along the fixed side of the door. Hinges 38 are mounted to the hanging stile 42 of the door 52 and along the jamb 40 of the door frame 34. Hinges 38 allow the door 52 to swing between a closed and open position. The stop 46 is located along the center plane of the frame 34. In a closed position the door 52 rests against the stop 46. A fixed side opening 48 is formed between the hanging stile 42 and jamb 40. A swinging side opening 50 is formed between the latch stile 44 and jamb 40. As the prior art door 52 closes, the fixed side opening 48 and the swinging side opening 50 narrow and close.

Figure 2:
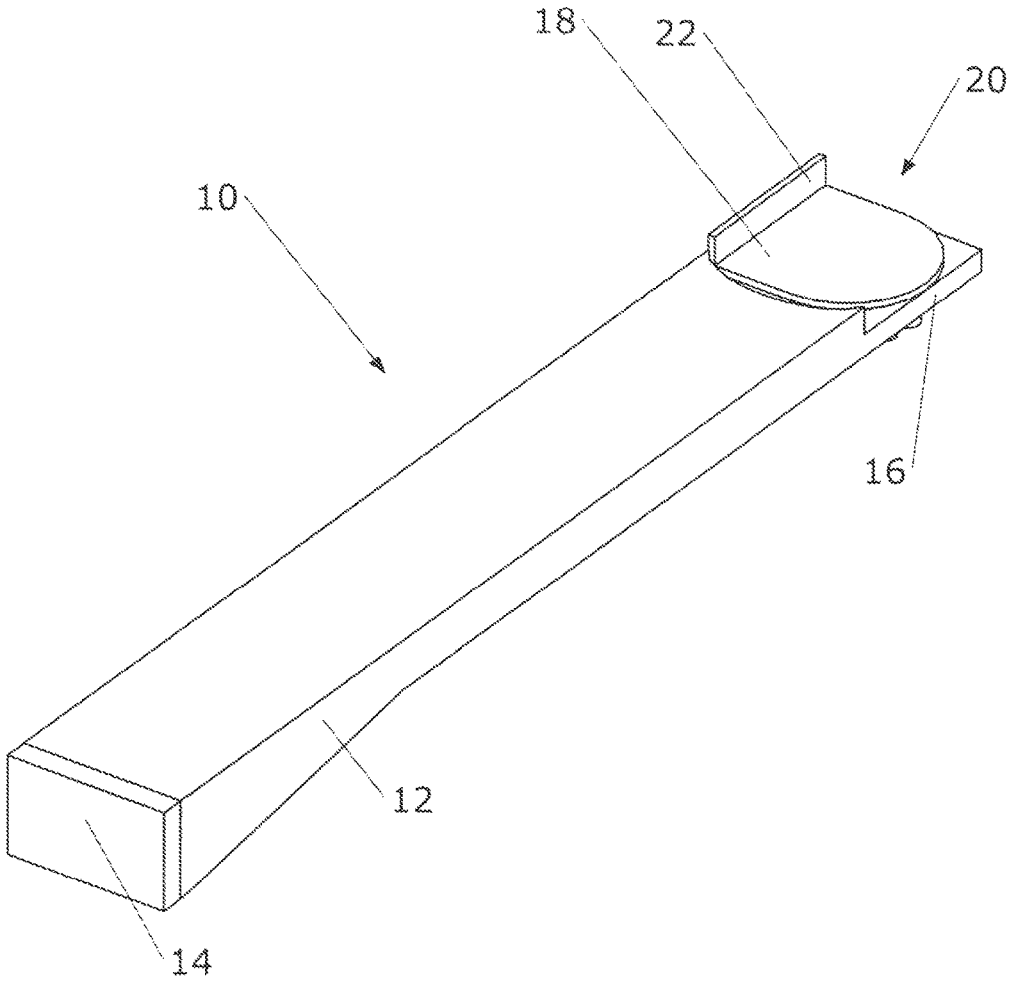
FIG. 2 is a perspective view, showing the present invention.

FIG. 2 illustrates the present guard device 10 provided under the present method. The guard device 10 is generally comprised of a pivoting member 12, bumper 14 and mounting system 20. Mounting system 20 can be any system that attaches guard device 10 to door stop while allowing pivoting member 12 to rotate along a horizontal plane to prevent a door from closing.

Figure 3:
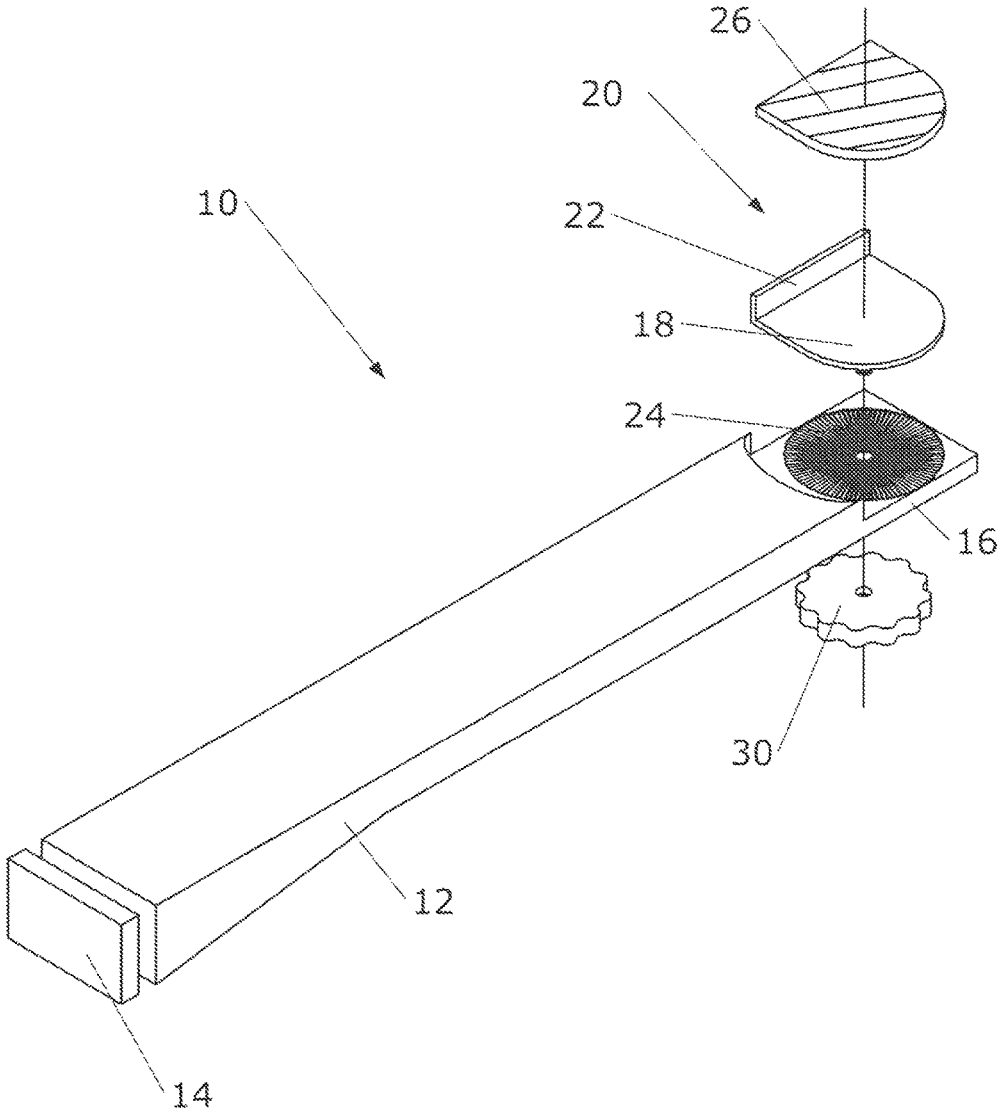
FIG. 3 is an exploded view, showing the component parts of the present invention.

FIG. 3 is an exploded view showing the component parts of guard device 10. Bumper 14 attaches to pivoting member 12 at the second end of guard device 10. Attachment member 16 connects to or is integral with pivoting member 12 at the first end of guard device 10. Attachment member 16 includes a central void to accept mounting system 20. Mounting system 20 is attached to attachment member 12 such, that pivoting member 12, bumper 14 and attachment member 16, swivel along a horizontal plane with respect to mounting system 20. Mounting system 20 can be any system capable of attaching guard device 10 to door stop (shown in FIG. 5 and 6) which allows guard device 10 to pivot.

Figure 4:
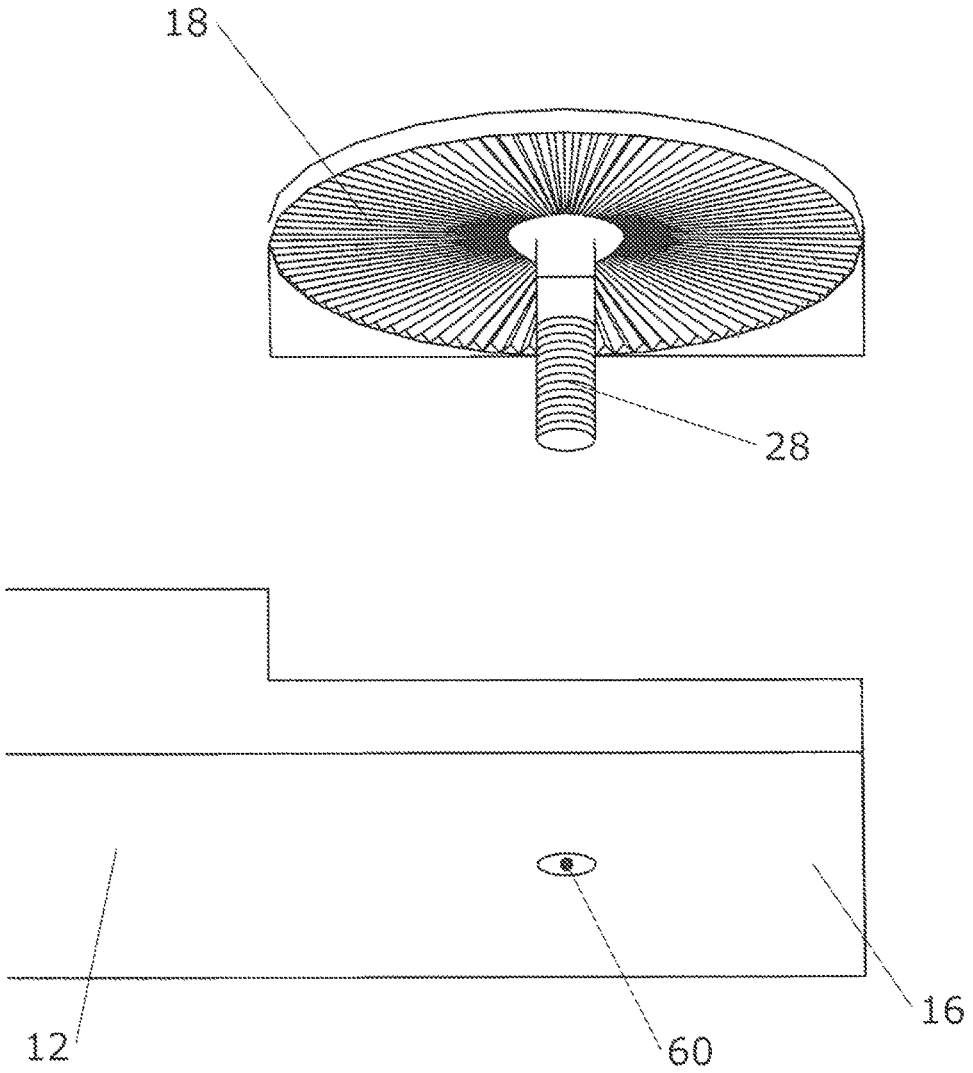
FIG. 4 is an exploded view, showing the bracket attachment of the present invention.
Figure 5:
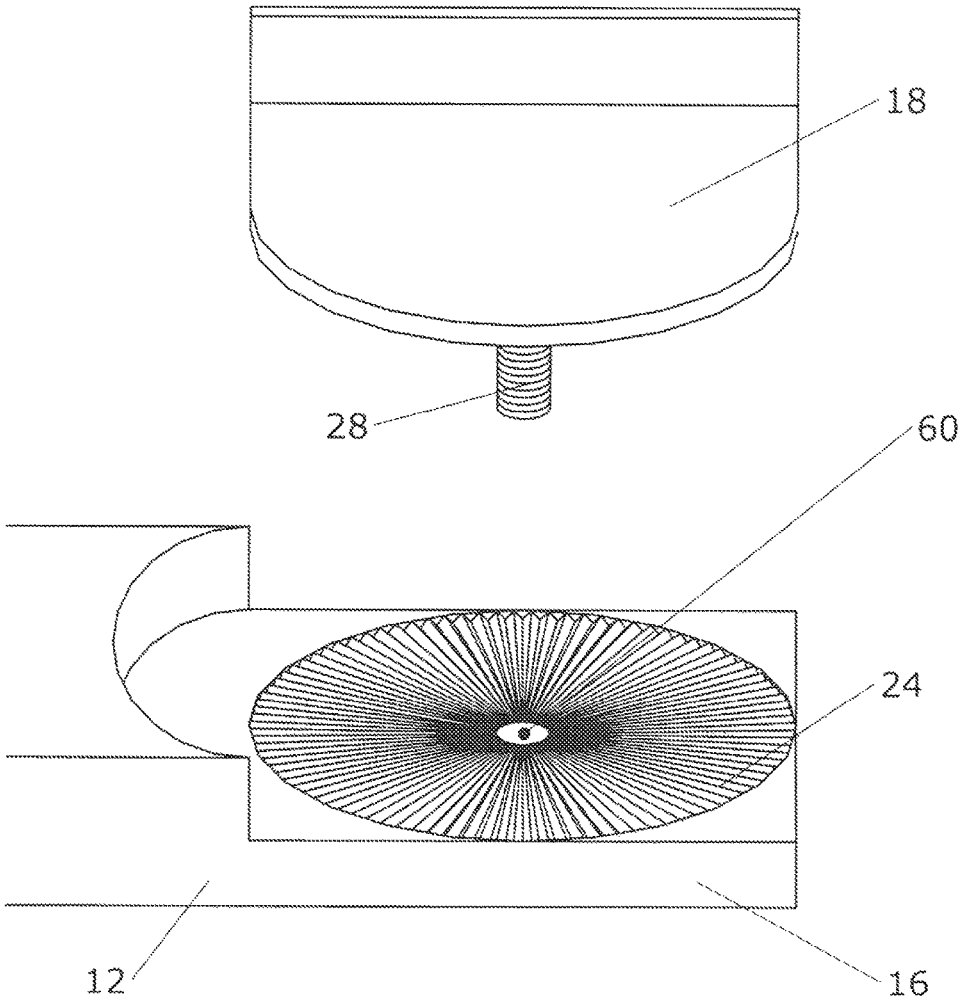
FIG. 5 is an exploded view, showing the bracket attachment of the present invention.
Figure 6:
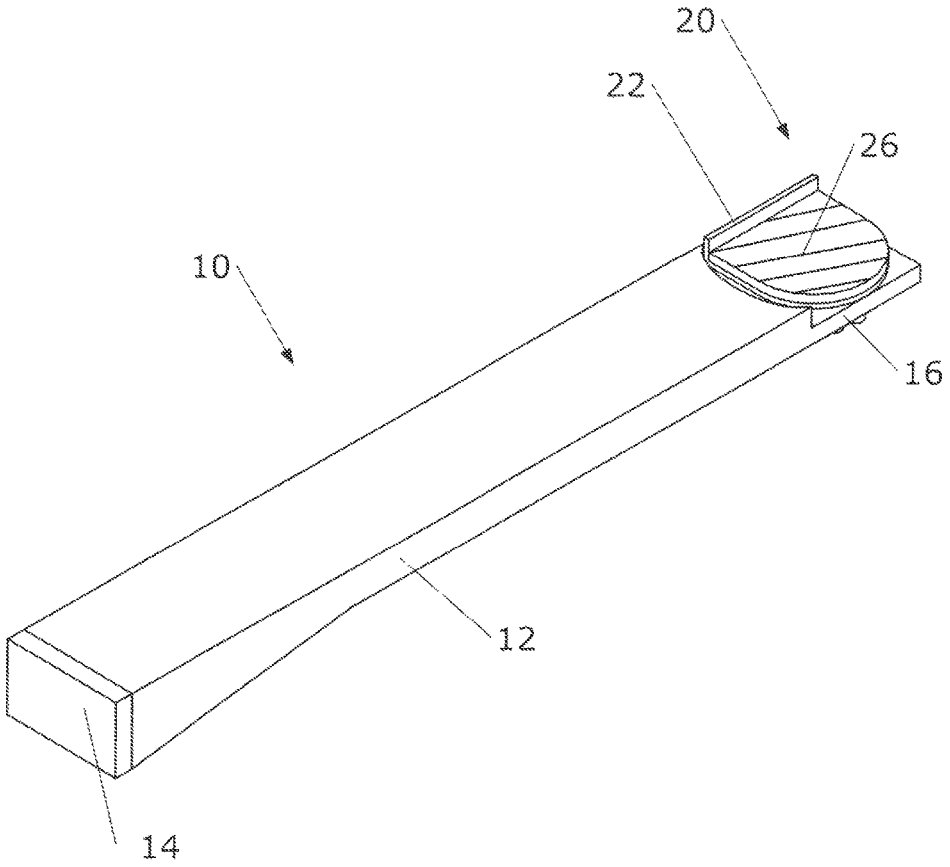
FIG. 6 is a perspective view, showing the present invention.

In the preferred embodiment, mounting system 20 is generally comprised of disc 24, bracket 18, attachment piece 26 and knob 30. Attachment piece 26 is aligned with central void 60 (referenced in FIG. 4) of attachment member 16, shown by axis line in FIG. 3. Bracket 18 includes a lip 22, which extends upward along the back edge of bracket 18. Bracket 18 includes an integrated bolt 28. Integrated bolt 28 extends through disc 24 and attachment member 16 to engage with knob 30. Disc 24 is capable of rotating with respect to pivoting member 12 (and attachment member 16). As illustrated in FIG. 4 the underside of bracket 18 is pleated. Similarly, FIG. 5 shows the pleated nature of the face of disc 24. The underside of bracket 18 engages with disc 24. Knob 30 secures bracket 18 and disc 24 in position. Attachment piece 26 is affixed to the top of bracket 18, as illustrated in FIG. 6. Attachment piece 26 can be a piece of double-sided tape. Pivoting member 12 swivels as attachment piece 26, bracket 18, disc 24 (engaged with bracket 18) and knob 30 (shown in FIG. 3) remain in position.

Figure 7:
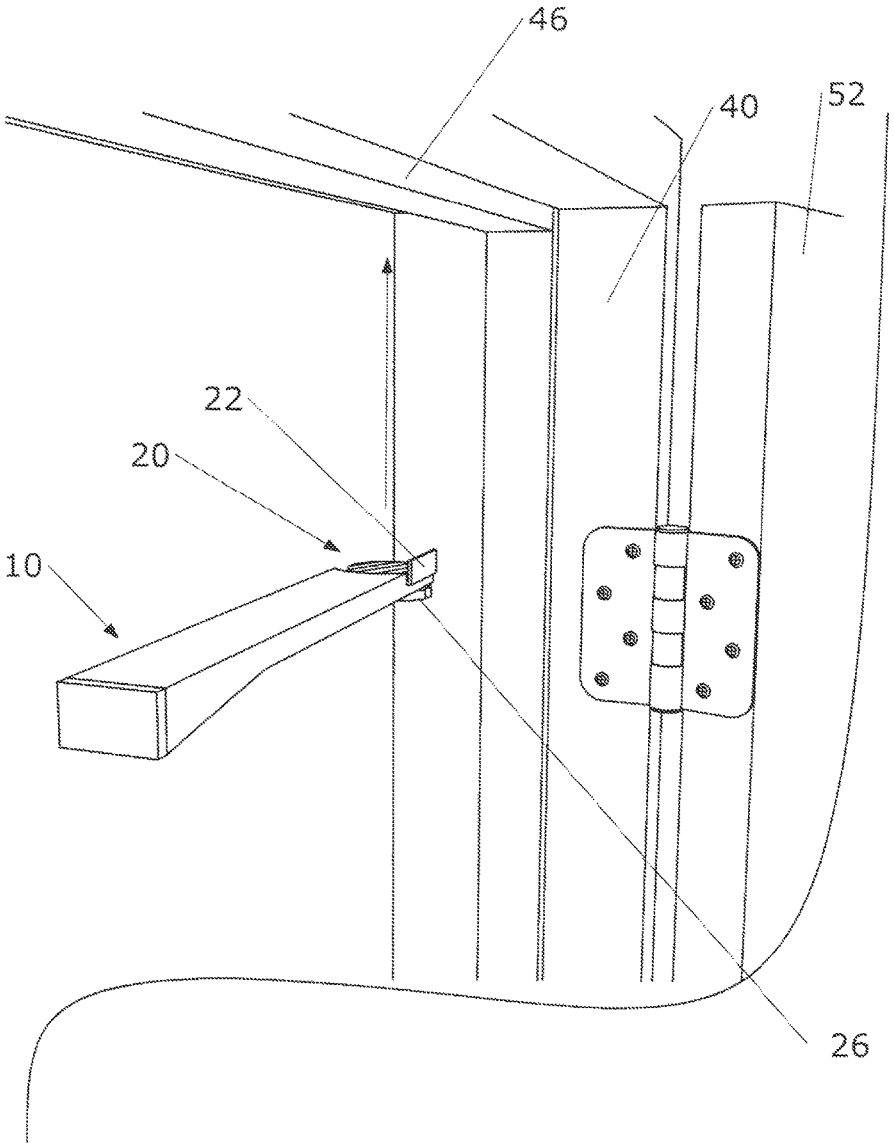
FIG. 7 is a perspective view, showing the present invention being installed along a door stop.
Figure 8:
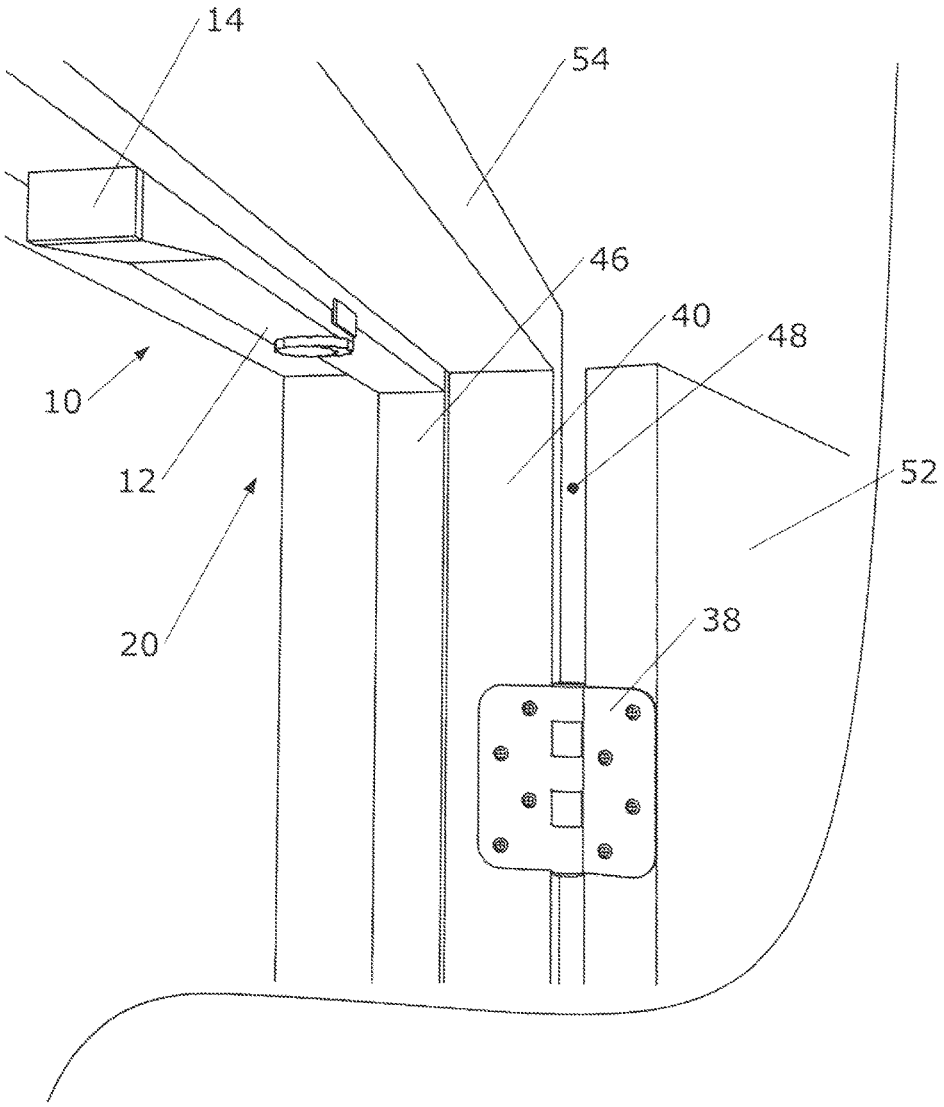
FIG. 8 is a perspective view, showing the present invention installed on a door stop.

The installation of guard device 10 is illustrated in FIG. 7. This step of the method consists of attaching guard device 10 along the top edge of a prior art door stop 46. Lip 22 rests against the edge of door stop 46 (closest to the hinged side of door jamb 40) and attachment piece 26 (e.g. double-sided tape) affixes to door stop 46, as shown by the arrow. Guard device 10 can be installed on existing door frames without modifying the door frame 34 or the door 52 itself. When fully installed and not in use, guard device 10 remains in a first position along the length of door stop 46, as shown in FIG. 8. Mounting device 20 allows guard device 10 to remain securely attached to the door frame. In this first position, door 52 can easily close without being obstructed by guard device 10.

Figure 9:
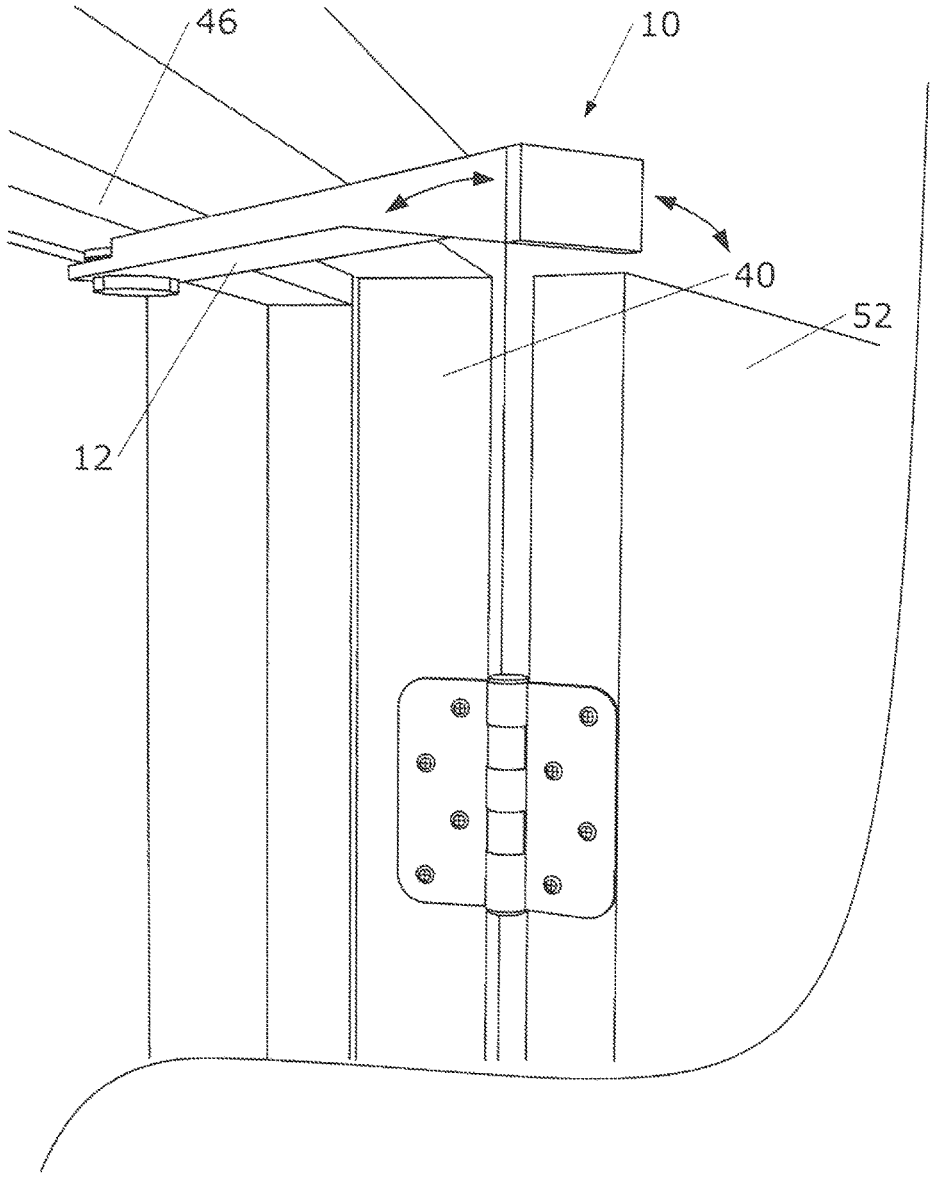
FIG. 9 is a perspective view, showing the present invention pivoting outward into position to stop a prior art door.

In use, guard device 10 is capable of swiveling along a horizontal plane towards door 52, as shown in FIG. 9 (arrows to illustrate the movement of pivoting member 12). Mounting device 20 allows the user to easily reach up to the guard device 10 and pivot the device 10 into second position (illustrated in FIG. 10). The placement of guard device 10 along the top of the door frame 34 will also prevent children from displacing guard device 10 such that door 52 may inadvertently swing shut.

Figure 10:
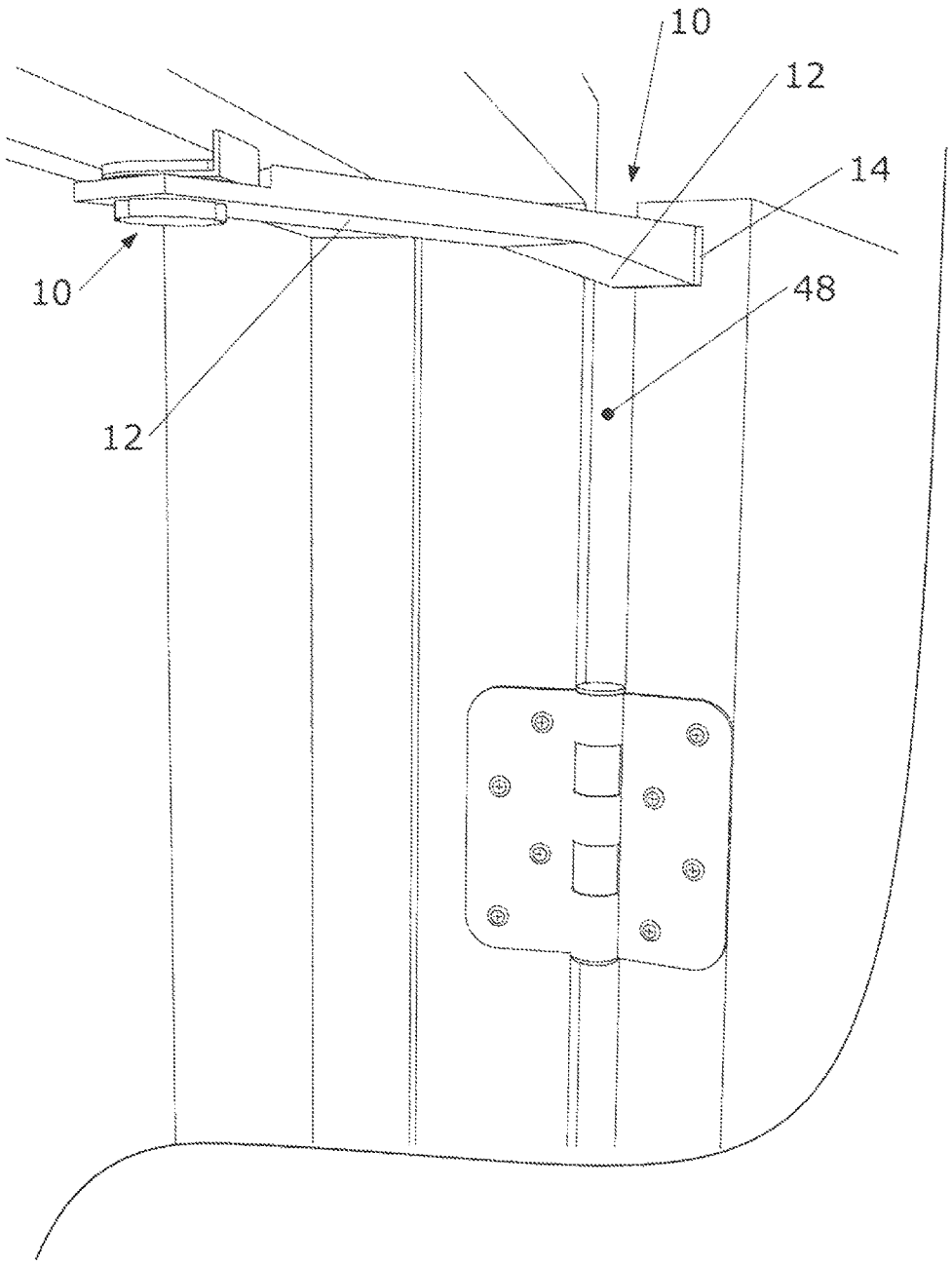
FIG. 10 is a perspective view, showing the present invention in use.

Guard device 10 is capable of maintaining fixed side opening 48 (along hanging stile 42) in an open position (second position), shown in FIG. 10. Guard device 10 contacts door 52 to prevent fixed side opening from narrowing. Often individuals place their hands or fingers along the door jamb 40 within fixed side opening 48. Due to the fact that the fixed side opening 48 closes at a much faster rate than the swinging side opening 50 as the door closes, individuals have less time to react and remove their hands from the jamb 40. Guard device 10 prevents fixed side opening 48 from trapping appendages or objects by maintaining the open position of the fixed side opening 48. As illustrated in FIG. 10 fixed side opening 48 will not close or substantially narrow while guard device 10 is engaged.

Figure 11:
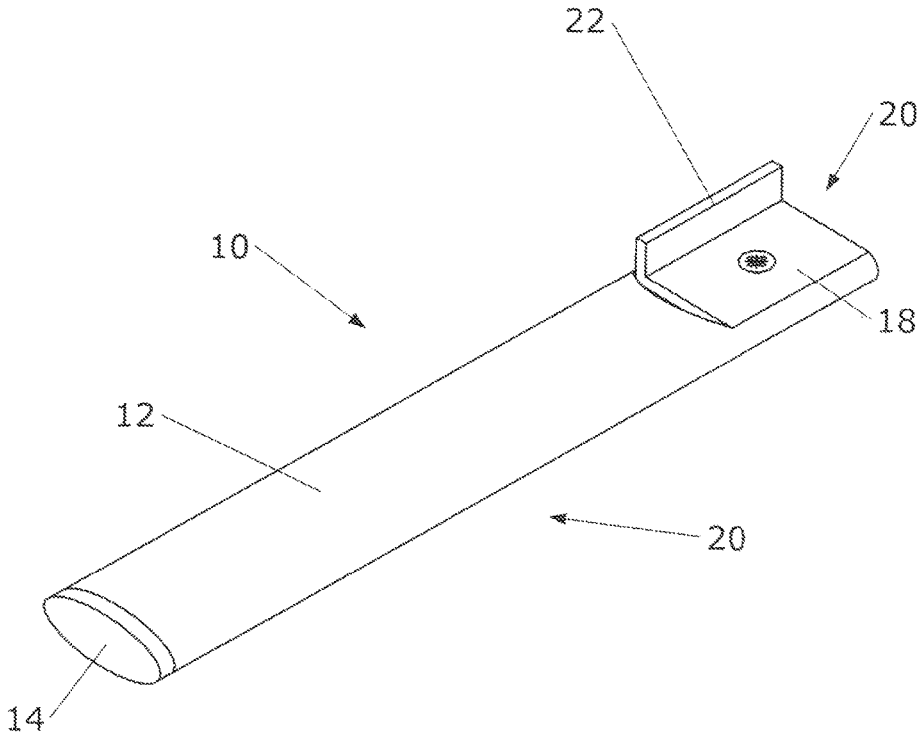
FIG. 11 is a perspective view, showing an alternate embodiment of the present invention.

An alternate embodiment of the present invention is illustrated in FIG. 11. The alternate embodiment shows guard device 10 in a different shape. Guard device 10 can be formed in any known shape such that guard device 10 can maintain a position along the length of the door stop 46 in order to allow door 52 to close when guard device 10 is not in use.

Figure 12:
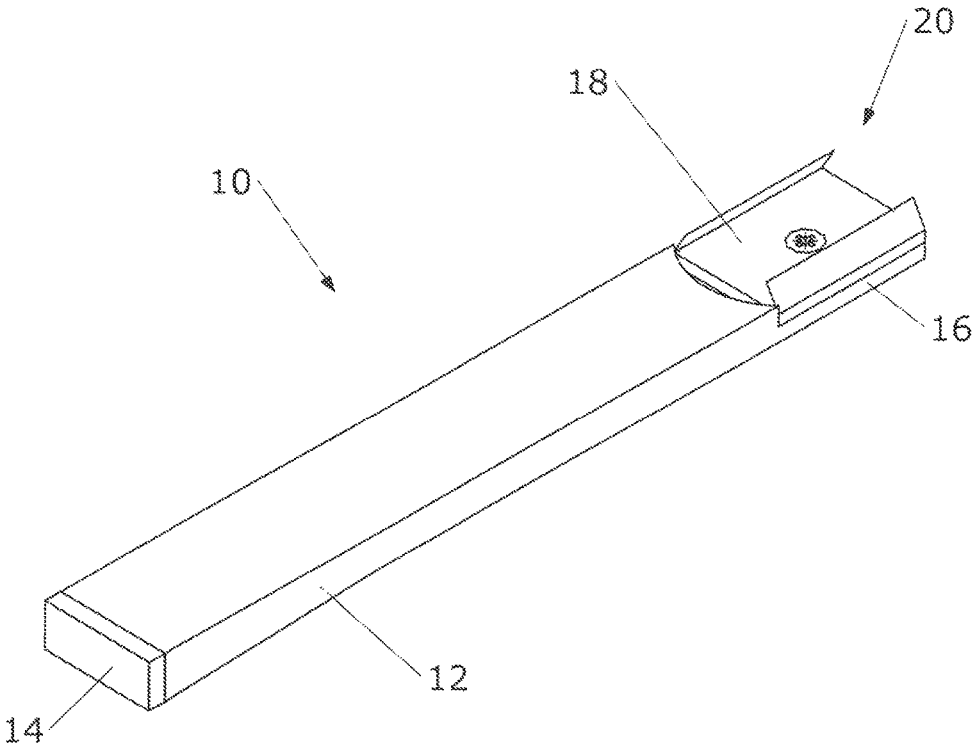
FIG. 12 is a perspective view, showing an alternate embodiment of the present invention.
Figure 13:
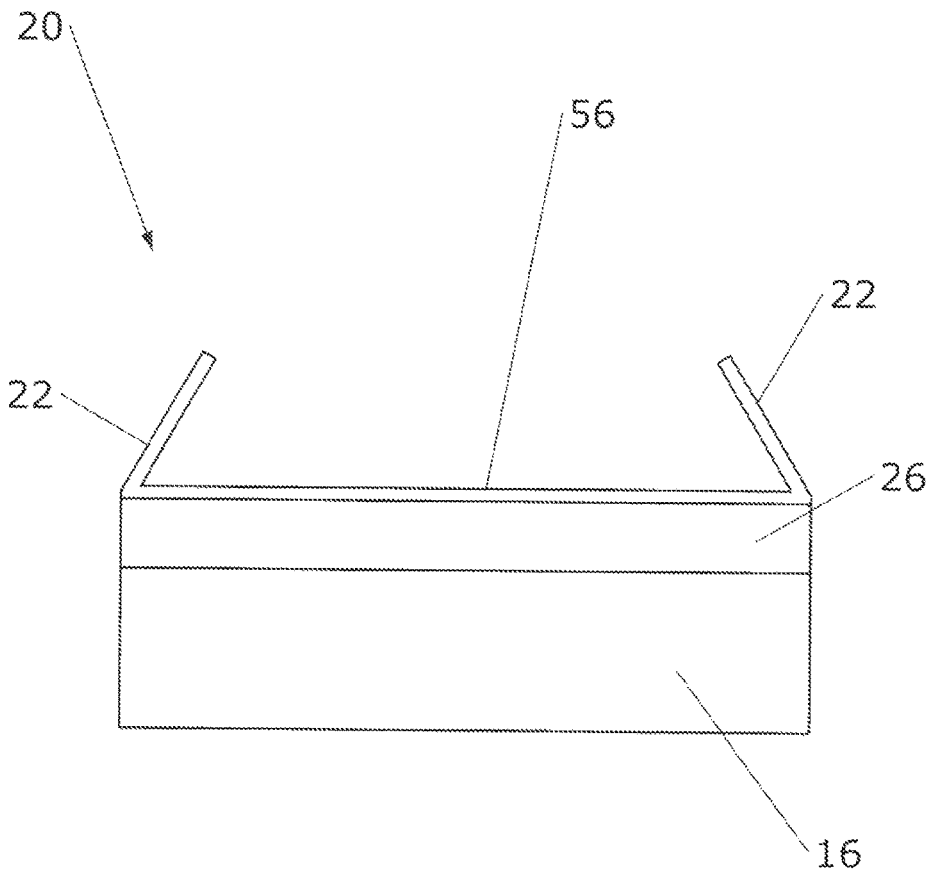
FIG. 13 is an elevation view, showing an alternate embodiment of the present invention.

A second alternate embodiment is illustrated in FIGS. 12 and 13. In the second alternate embodiment mounting system 20 is modified. Mounting system 20 includes a modified bracket 56 which engages door stop 46 by frictional engagement rather than the use of double-sided tape. FIG. 12 is a perspective view showing bumper device 14 attached to pivoting member 12 and attachment member 16. Modified bracket 56 attaches a pivoting washer (not visible in the present figure) to attachment member 16 such that pivoting member is still capable of pivoting along a horizontal plane. An elevation view of mounting system 20 is shown in FIG. 13. Bracket 56 includes two lips 58 which are biased inward. Lips 58 engage with the side edges of door stop 46.

The preceding description contains significant detail regarding the novel aspects of the present invention. It should not be construed, however, as limiting the scope of the invention but rather as providing illustrations of the preferred embodiments of the invention. As an example, the guard device 30 can include a modified mounting system. Additionally, guard device 10 can be many different shapes and sizes. Thus, the scope of the invention should be fixed by the following claims, rather than by the examples given.

The invention claimed is:

1. A method and system of maintaining a fixed side opening of a door having a door frame with a top edge, a door jamb and a door stop, wherein said method thereby prevents said door from closing along said door jamb of said door frame along said door stop, said method comprising the steps of:

a. providing a guard device having:
   i. a pivoting member having a central axis, a first and a second end wherein said first end has a central void having a central axis, wherein said central axis of said central void and said central axis of said pivoting member are perpendicular to one another;
   ii. an attachment member connected to said first end of said pivoting member;

iii. a mounting system attached to said pivoting member at said central void;

iv. wherein said mounting system allows said guard device to swivel about said axis of said central void;

v. wherein said mounting system comprises:

a disc mounted to said attachment member such that said disc is capable of rotating;

a bracket configured to engage with said disc having an integral bolt;

wherein said integral bolt of said bracket is capable of extending through said disc and said attachment member at said central void to engage with a knob; and wherein said knob secures said bracket and said disc together b. attaching said mounting system to said door stop of said top edge of said door frame such that said guard device is horizontally oriented can swivel from a first position to a second position;

c. swiveling said guard device into said first position proximate said door stop such that said door is capable of closing; and d. swiveling said guard device into said second position such that said guard device is capable of maintaining said fixed side opening.

2. The method and system as recited in claim 1, wherein said mounting system includes an attachment piece affixed to the top of said bracket such that said attachment piece can connect said guard device to said door stop.

3. The method and system as recited in claim 2, wherein said attachment piece is a piece of double-sided tape.

4. The method and system as recited in claim 1, wherein said disc and said bracket includes pleats such that said pleats of said disc engage with said pleats of said bracket.

5. The method and system as recited in claim 1, wherein said mounting system includes an attachment piece fully integrated with said bracket such that said attachment piece can connect said guard device to said door stop.

6. The method and system as recited in claim 1, wherein said bracket of said mounting system includes a lip capable of engaging the edge of said door stop.

7. A method and system of maintaining a fixed side opening of a door having a door frame with a top edge, a door jamb and a door stop, wherein said method thereby prevents said door from closing along said door jamb of a said door frame, said method comprising the steps of:

a. providing a guard device having:

i. a pivoting member having a first and a second end;

ii. an attachment member connected to said first end of said pivoting member;

iii. a mounting system attached to said pivoting member;

iv. wherein said mounting system allows said guard device to swivel;

v. wherein said mounting system further comprises a bracket configured to engage with said pivoting member having an integral bolt;

wherein said integral bolt of said bracket is capable of extending through said attachment member at a central void to engage with a knob; and wherein said knob secures said bracket and said attachment member together; and b. attaching said mounting system to said door stop of said top edge of said door frame such that said guard device is horizontally oriented and capable of swiveling into a position to maintain said fixed side opening.

8. The method and system as recited in claim 7, wherein said mounting system includes an attachment member affixed to the top of said bracket such that said attachment member can connect said guard device to said door stop.

9. The method and system as recited in claim 8, wherein said attachment piece is a piece of double-sided tape.

10. The method and system as recited in claim 7, wherein said bracket of said mounting system includes a lip capable of engaging the edge of said door stop.

* * * * *